US007185880B1

(12) United States Patent
McCray

(10) Patent No.: US 7,185,880 B1
(45) Date of Patent: Mar. 6, 2007

(54) T-POST PULLER CLAW

(76) Inventor: Donald E. McCray, 1017 W. Old National Trail, Greenville, IL (US) 62246

( * ) Notice: Subject to any disclaimer, the term of this patent is extended or adjusted under 35 U.S.C. 154(b) by 0 days.

(21) Appl. No.: 11/294,064

(22) Filed: Dec. 5, 2005

(51) Int. Cl.
*B66F 3/06* (2006.01)

(52) U.S. Cl. ..... 254/30

(58) Field of Classification Search ..... 254/30, 254/31, 29 R, 131, 132
See application file for complete search history.

(56) References Cited

U.S. PATENT DOCUMENTS

| | | | | |
|---|---|---|---|---|
| D241,506 | S | * 9/1976 | Condos | D8/344 |
| 4,721,335 | A | 1/1988 | Krenek, Jr. | |
| 4,738,433 | A | 4/1988 | Hoff | |
| 4,792,120 | A | 12/1988 | Egaas | |
| 4,846,445 | A | 7/1989 | Pfeffer | |
| D312,196 | S | 11/1990 | Norona | |
| 5,042,591 | A | 8/1991 | Hull | |
| 5,100,104 | A | 3/1992 | Wagner | |
| D337,412 | S | 7/1993 | Ruggles | |
| 5,681,030 | A | 10/1997 | Nall | |
| 5,713,559 | A | 2/1998 | McClarin et al. | |
| D431,431 | S | 10/2000 | Allen et al. | |
| 6,352,242 | B1 | 3/2002 | Medearis | |

* cited by examiner

*Primary Examiner*—Robert C. Watson
(74) *Attorney, Agent, or Firm*—Woodard, Emhardt, Moriarty, McNett & Henry LLP

(57) ABSTRACT

A T-post puller claw for pulling a T-post out of the ground includes a claw body having a first panel, a second panel, and an included angle therebetween. The first panel defines a triangular opening to slide over a T-post. The second panel defines a keyhole opening for receiving a length of chain and a first chain-securing slot. The second panel further defines a second chain-securing slot. When a length of chain is threaded into the T-post puller claw, one chain link is received by the first slot and a different chain link is received by the second slot. When a lifting force is applied to the length of chain, the T-post puller claw pivots into a clamping configuration against the T-post, enabling the T-post to be pulled out of the ground.

16 Claims, 6 Drawing Sheets

T-POST PULLER CLAW

BACKGROUND OF THE INVENTION

The present invention relates in general to devices that are constructed and arranged to be used for pulling T-type fence posts (T-posts) out of the ground. More specifically, the present invention relates to a pulling device the fits over the T-post and is pulled upwardly on by using a length of chain and a vehicle or similar powered machinery, such as a tractor. One feature of the present invention is the specific geometry of the device relative to its size and its lifting force location that results in a unique clamping action that prevents bending of the T-post during extraction from the ground.

T-posts of the type described herein can be used for a variety of job requirements, such as supports for fencing, either permanent or temporary, for highway signs, or for staking a newly-planted tree, to mention only a few examples. As these uses would suggest or imply, there may come a time that the T-post needs to be removed from the ground. Removal may be prompted due to relocating, such as a fence or sign location, or removal may be prompted due to the need being eliminated, such as when the tree no longer needs the staking support. Considering the size, weight, and cost of each T-post, it is intended that the T-post be salvaged so that it can be reused at some other location or for some other application. In this regard, it therefore becomes important that the removal procedure and the equipment or components utilized for removal be such that the T-post is not bent or otherwise damaged as it is pulled from its installed position in the ground. Further, since a large number of T-posts may need to be extracted, the time to set up and attach the device to each T-post must be a consideration. The simplicity and reliability of the present invention is an advantage.

One of the challenges facing T-post removal is that the T-posts are securely anchored into the ground and the ground is often hard and dry. A further consideration is the amount of space or clearance around the T-post. For example, in the situation where the T-post is used for staking a newly-planted tree, as the tree grows and fills out, the T-post becomes less accessible. The present invention addresses these challenges by the design of a relatively small T-post puller claw that slides over the T-post and is pulled upwardly on by using a length of chain that is connected to some type of motorized vehicle or powered equipment, such as a tractor. This allows the access to come in from the top of the T-post, rather than needing to come in from the side. As a result, even fairly tight spaces are accessible, assuming that there is sufficient height clearance.

Related to the challenge of pulling the T-post out of hard, dry soil is the challenge of not bending or otherwise damaging the T-post in the process so that it can be reused. The present invention provides a unique puller claw shape with a cooperating geometry and a corresponding lifting point location, such that lifting up on the connected chain applies spaced-part force pressure points that prevent bending of the T-post during extraction from the ground. To some extent, regardless of what force level has to be applied in order to pull the T-post out of the ground, the various force vectors, including the overall shape and geometry of the T-post puller claw, cooperate to simply make the overall clamping abutment that much tighter. With regard to the motorized vehicle or powered equipment, i.e., a tractor, all that is required is an attachment or other connection arrangement for grasping onto the upper end length of chain with a capability of producing a sufficient vertical lifting force.

As will be understood from the following description, the present invention provides a simple and reliable device in the form of the described T-post puller claw that can be readily applied and quickly and easily removed from a T-post. The size and shape of the puller claw creates a clamping structure against the T-post once the claw is lifting upwardly at the lift point location by the connected length of chain. While a length of chain is described for the preferred embodiment, because of its interlocking links and the alternating turning of those links, other components and structures are contemplated, such as a cable or wire rope that would be connected to the T-post puller claw so as to generally maintain or preserve the same lifting force location.

BRIEF SUMMARY OF THE INVENTION

A T-post puller claw for use in pulling an installed T-post out of the ground according to one embodiment of the present invention comprises a claw body having a first panel and a second panel wherein the first and second panels are arranged relative to each other to define an included angle. The first panel defines a T-post receiving opening and the second panel defines a chain-receiving opening. The chain-receiving opening includes a first chain-securing slot. The second panel further defines a second chain-securing slot that opens through an outer edge of the second panel and is spaced apart from the first chain-securing slot.

One object of the present invention is to provide an improved T-post puller claw.

Related objects and advantages of the present invention will be apparent from the following description.

DETAILED DESCRIPTION OF THE INVENTION

Figure 1:
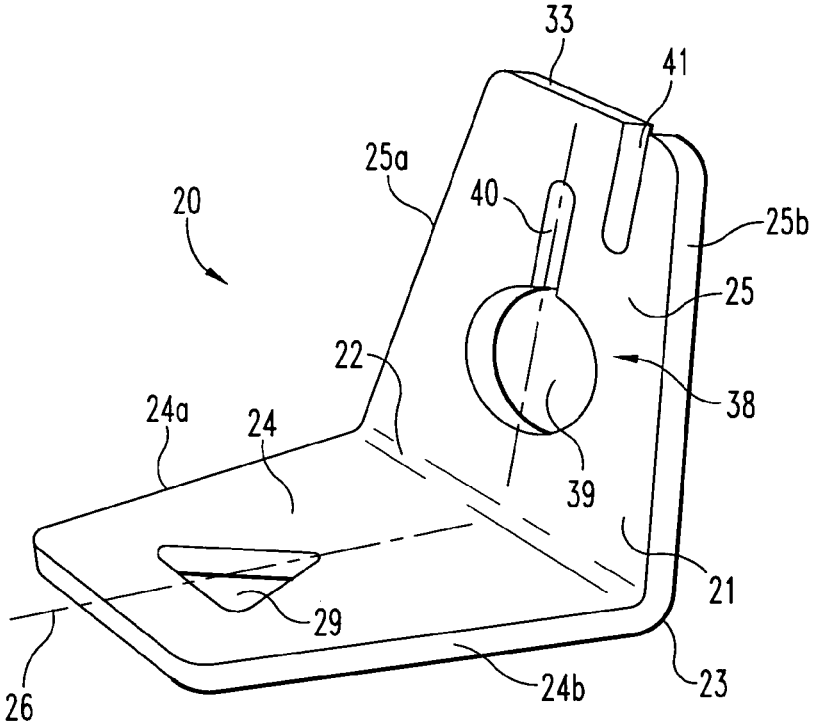
FIG. 1 is a perspective view of a T-post puller claw according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–4, there is illustrated a T-post puller claw 20 that is used to assemble to a T-post of conventional construction and thereafter pivot to clamp against the T-post. This pivoting action of the T-post puller claw 20 is the result of the size and shape of claw 20, the size and shape of its various openings, and the location of the force lift point, as will be described in greater detail herein.

T-post puller claw 20 begins as a substantially flat plate 21 of steel or similar strong, durable metal into which the requisite shapes are stamped or machined. The next step is to bend plate 21 along its approximate lateral centerline 22 to an approximate 90 degree bend 23 so as to form the two panels 24 and 25 into what has the appearance of an angle iron. The included angle of bend 23 as positioned between the two panels 24 and 25 can range from 75 degrees to 105 degrees and still be suitable for the intended purpose. Angles significantly lower or higher than this range, considering the various force vectors and their directions, could result in the T-post puller claw bending. The starting outline shape of plate 21 is generally rectangular, though with a slight inward taper to sides 24*a*, 24*b*, 25*a*, and 25*b*, as these sides extend away from lateral centerline 22. Further, panels 24 and 25 are centered on and symmetrical about longitudinal centerline 26.

In terms of an alternate construction for T-post puller claw 20, it is envisioned that this component can be manufactured as a casting using cores to create the required openings. Considering the material options, the strength requirements, and the tolerances for the various openings, a cast product is acceptable for T-post puller claw 20.

Figure 3:
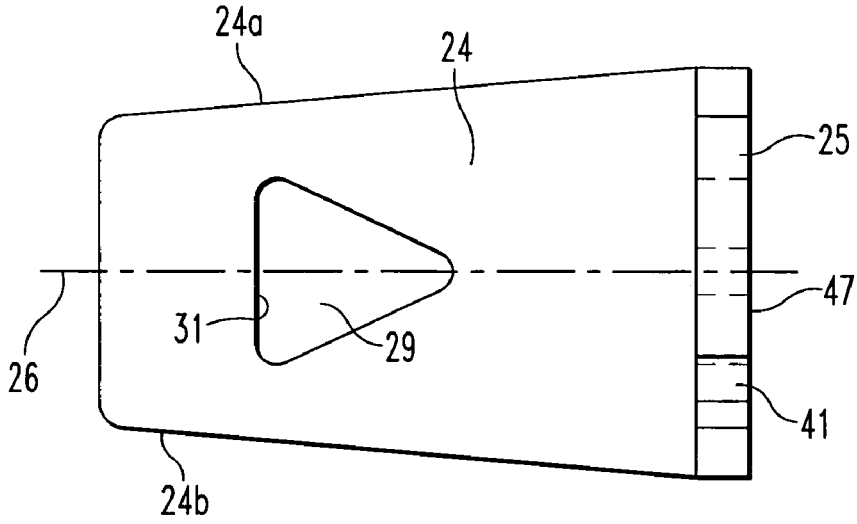
FIG. 3 is a top plan view of the FIG. 1 T-post puller claw.
Figure 3A:
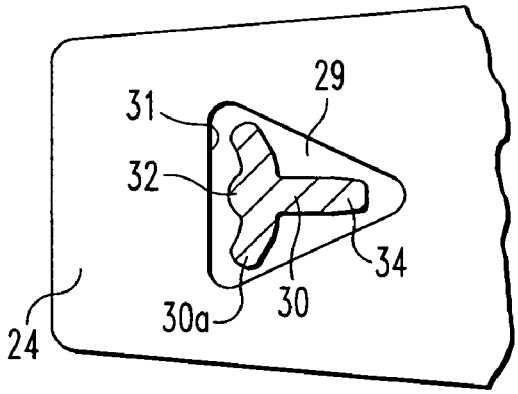
FIG. 3A is a partial, diagrammatic, top plan view of the FIG. 1 T-post puller claw as assembled onto a T-post.
Figure 4:
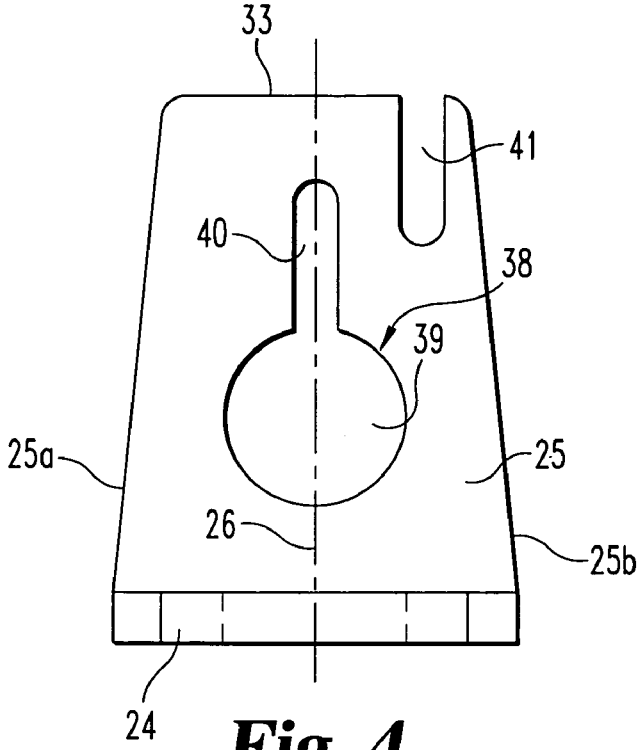
FIG. 4 is a front elevational view of the FIG. 1 T-post puller claw.

Panel 24 defines a generally triangular opening 29 that is shaped to slide over a T-post 30, see FIG. 3A, wherein the lateral cross sectional shape of the T-post 30 is illustrated. As will be appreciated from the illustrations provided, there is clearance between the inner edges of opening 29 and T-post 30. This clearance allows panel 24 to shift and for edge 31 to lock beneath one of the ears 32 and for the entire claw 20 to pivot such that panel edge 33 is moved into contact against lower bar 34. This pivoting motion is created by securing a chain to the T-post puller claw 20 and then pulling upwardly on the chain with another device, implement, or equipment, such as a tractor. It should also be noted that opening 29 is centered on longitudinal centerline 26.

Panel 25 defines a keyhole opening 38 that includes a circular aperture 39 and, opening into aperture 39, a more narrow slot 40. The opening 38 is substantially centered on longitudinal centerline 26 and this includes slot 40 also being substantially centered on longitudinal centerline 26. Opening into panel 25 from edge 33 is a slot 41 whose width is substantially the same as the width of slot 40. Opening 38 in cooperation with slot 41 is used to secure a length of utility chain (link chain) to T-post puller claw 20 so as to be able to apply an upward lifting force on claw 20 once it is assembled onto a T-post, such as T-post 30.

Figure 5:
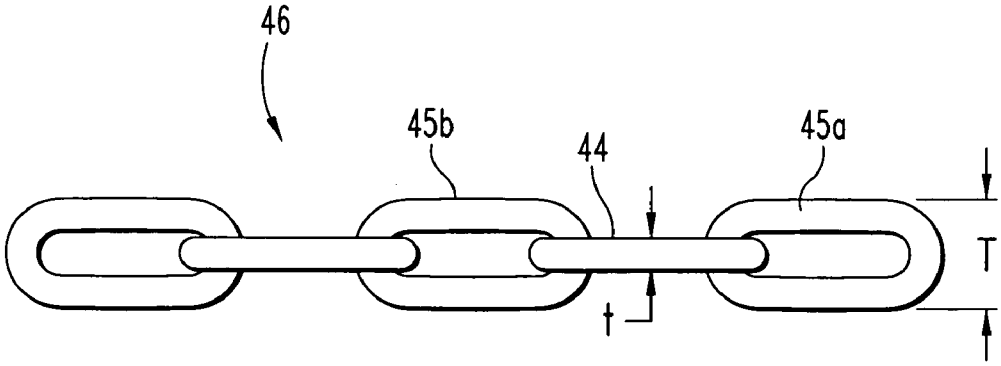
FIG. 5 is a front elevational view of a length of link chain illustrating the relevant dimensions.

As for the size and style of chain to be selected, the preferred chain is of a closed link design with adjacent links interlocked and turned at 90 degrees to each other, see FIG. 5. In terms of thickness or width, one link 44 has a thickness (t) that generally corresponds to the diameter or gauge of the metal used to form link 44. The adjacent links, 45*a* and 45*b*, while of the same general construction, size and material of link 44, are each turned approximately 90 degrees relative to link 44. Further, these adjacent links have a "thickness" (T) that generally corresponds to the width of the oval shape of the link. This thickness dimension (T) is slightly more than 3 times the more narrow thickness (t) of the receiving link 44. This allows the same link design to be interlocked.

What should be appreciated from this chain length description is how the opening 38 and slots 40 and 41 function and cooperate with the length of chain 46. While only four links are illustrated in FIG. 5, the actual length of chain will be whatever is required to connect at one end to T-post puller claw 20 as described herein and to connect the opposite end to the vehicle or equipment that has been selected to provide the upwardly lifting force.

Figure 2:
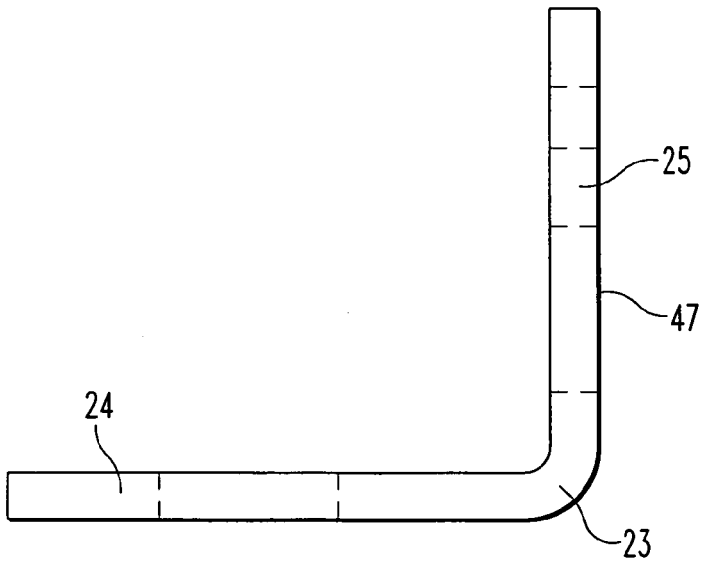
FIG. 2 is a side elevational view of the FIG. 1 T-post puller claw.

In order to connect the length of chain 46 to claw 20, the chain 46 is threaded into opening 38 from the direction of outer surface 47 of panel 25 (see FIG. 2). Opening 38 is larger than the oval (minor) width (dimension T) so the length of chain 46 passes through opening 38 without interference. Opening 38 does not need to be any larger than a size that is sufficient to receive chain 46, depending on the chain size or gauge selected. Once the desired lifting force is known, this will dictate what chain should be selected.

Figure 6:
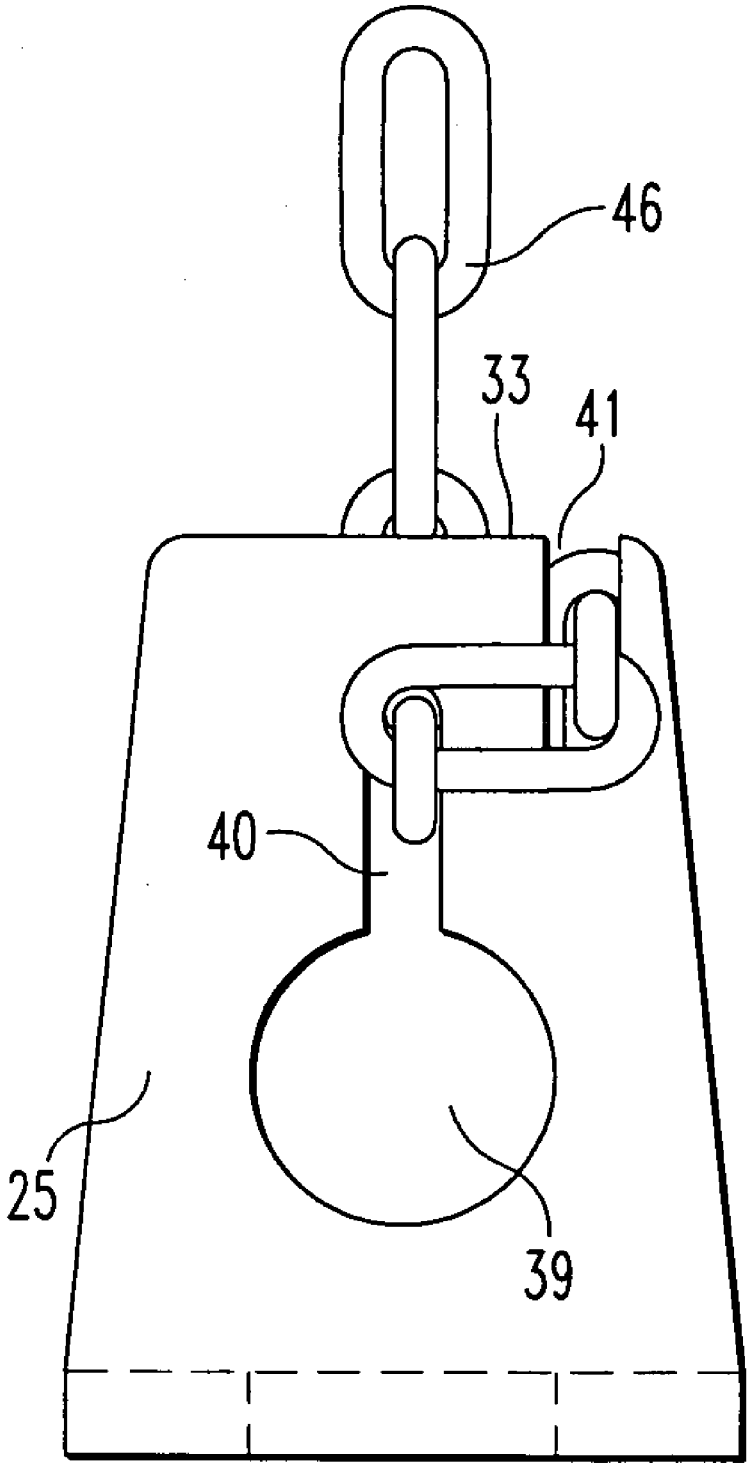
FIG. 6 is a perspective view of the FIG. 5 link chain threaded through one portion of the FIG. 1 T-post puller claw.

With several links of chain 46 extended through opening 38, one link is inserted into slot 40. The width of slot 40 is just slightly greater than the dimension (t) for that link. Once the selected link slides into slot 40, it will be understood that pulling on the length of chain 46 in either direction, as if to pull it through panel 25, causes one of the adjacent links 45*a* or 45*b* to abut up against panel 25 due to their greater width dimension (T) which is significantly greater than the width of slot 40. The portion or strand of chain that was inserted through opening 38 and is now dangling loose is next threaded into slot 41, in virtually the same way as the chain was inserted and secured into slot 40. With reference to FIG. 6, the length of chain has been threaded through opening 38 with one link secured into slot 40 and a different link secured into slot 41. Anchoring the free end of chain 46 into slot 41 in this manner prevents the upstream section of chain that is secured into slot 40 from inadvertently coming free and moving into circular aperture 39. If allowed to come free and move into circular aperture 39, then the length of chain would be able to pull free from claw 20. By taking the dangling end of chain 46 and tightly pulling it to get the shortest section of chain possible between the link in slot 40 and the link in slot 41, the length of chain 46 becomes securely connected to claw 20.

In order to remove chain 46 from claw 20, the one securing link simply slides out of slot 41 and then the other securing link slides out of slot 40. This allows the length of chain to be pulled free from claw 20. However, it should be understood that alternating tension and slack on chain 46 with the links properly secured within slots 40 and 41 does not allow the length of chain to become disconnected from claw 20. This means that the claw 20 and chain 46 connected combination can be easily moved from one T-post to another without having the chain release from the claw and thus without any need to repeatedly rethread the chain through the claw.

Figure 7:
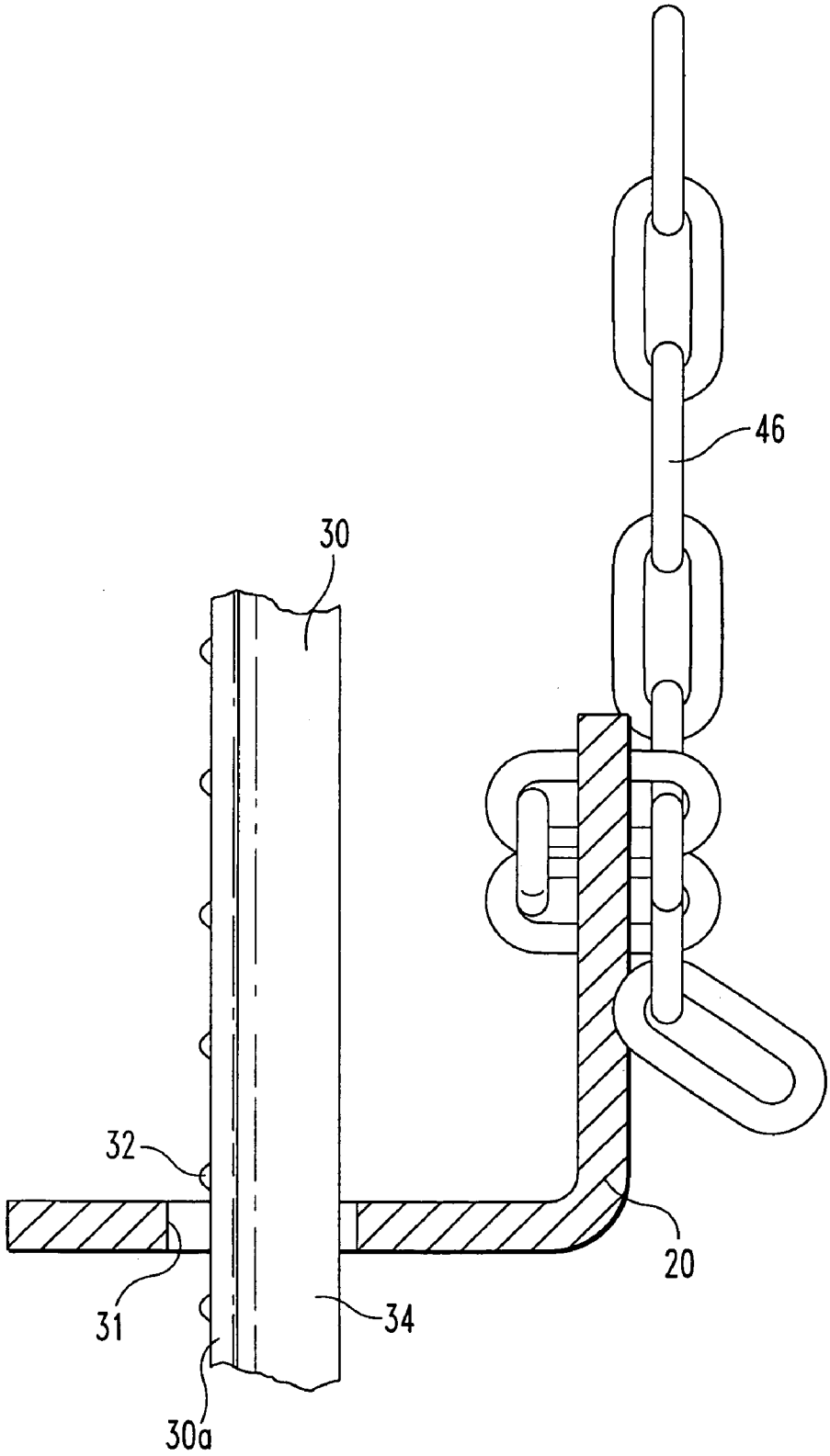
FIG. 7 is a side elevational view, in partial section, of the FIG. 1 T-post puller claw assembled to a T-post, prior to initiating a lifting force on the length of link chain.
Figure 8:
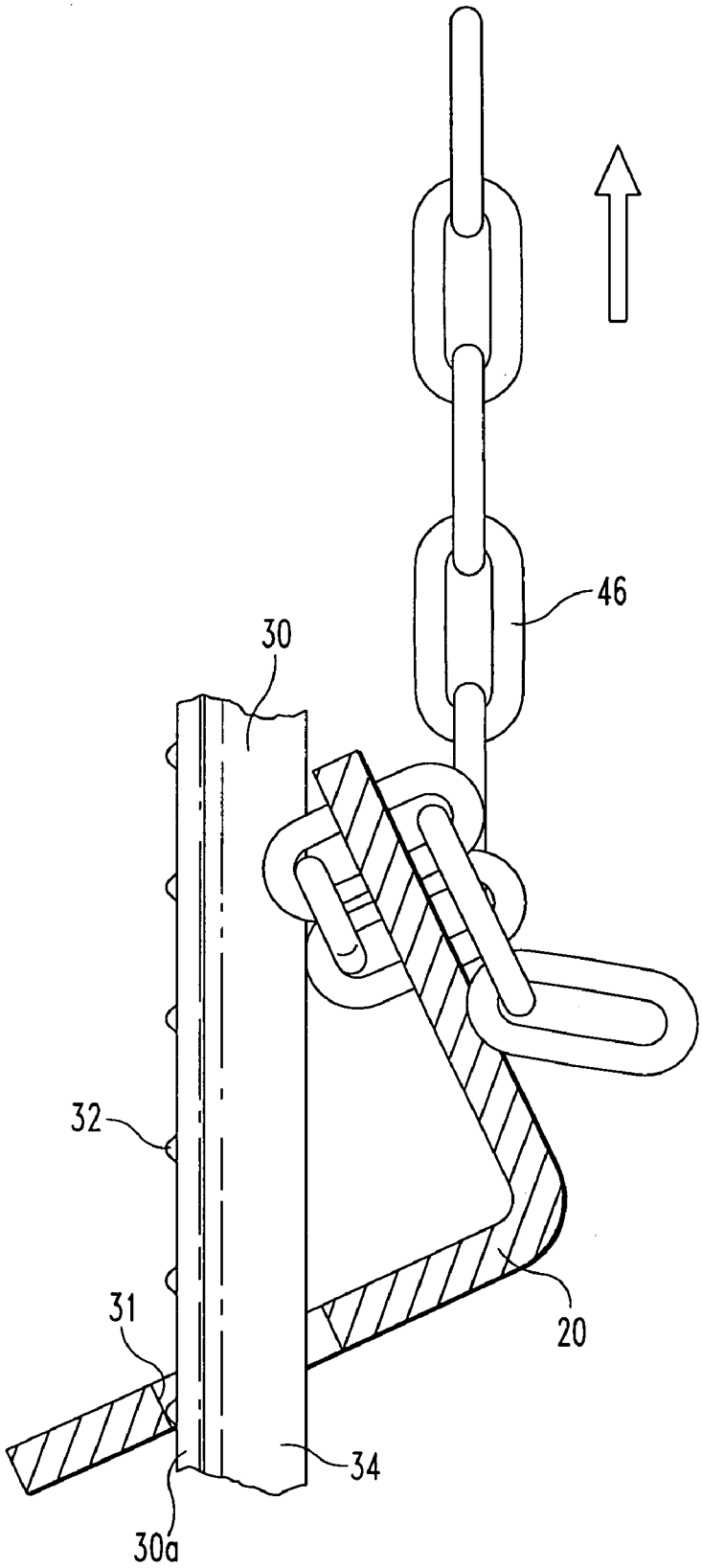
FIG. 8 is a side elevational view, in partial section, of the FIG. 1 T-post puller claw as assembled to a T-post with a lifting force applied and the T-post puller claw pivoted into contact with the T-post.

Referring now to FIG. 7, the starting orientation of claw 20, with the length of chain 46 secured, is illustrated as it initially slides down over a T-post 30. While the size of triangular opening 29 easily clears the ears 32 and lower bar 34, the clearance allows claw 20 to pivot in a counterclockwise direction based upon the FIG. 7 orientation so that edge 33 pivots into contact against the outer edge of lower bar 34 (see FIG. 8). By moving slot 41 to the side of panel 25 and not in the center or close to longitudinal centerline 26, the section of chain 46 extending from slot 40 to slot 41 does not interfere with the movement of edge 33 up against lower bar 34. This is also due in part to the relatively narrow width of lower bar 34.

As this pivoting action of claw 20 occurs, the base edge 31 of opening 29 is pulled into abutting engagement against T-post body 30*a* and into engagement with the (upper) adjacent ear 32. The precise location of base edge 31 in this clamping or abutting condition is actually at the corner between T-post body 30*a* and ear 32. What results from this pivoting action and the engagement of edge 31 against the T-post body 30*a* and ear 32 is a clamping action by claw 20 at two spaced-apart locations on opposite sides of the T-post 30, with these two clamping or force locations being at different axial heights (see FIG. 8). The first, upper clamping force location is by means of edge 33 positioned against lower bar 34 and the second, lower clamping force location is by means of edge 31 against T-post body 30*a* and ear 32. As the length of chain is tensioned, the lifting force simply increases the clamping forces exerted by claw 20 against T-post 30.

Importantly, based on where the clamping forces are applied by claw 20 onto T-post 30, specifically on opposite sides and at different axial heights, the T-post does not bend as it is being pulled out of the ground. The substantially vertical lifting force, regardless of what may be required to do the job, simply translates into substantially equal and opposite clamping forces that tend to negate any bending moment that might otherwise be introduced. Without any significant bending moment force, there is nothing to cause bending of the T-post 30 as it is being extracted from the ground.

When the length of chain 46 is given slack, the claw 20 automatically begins to pivot back to the FIG. 7 orientation. With more slack, the location of claw 20 on the T-post 30 can be lowered, if desired, though the more likely action would simply be to lift the claw 20 off of the T-post 30 so as to be reapplied to another T-post.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A T-post puller claw for use in pulling an installed T-post out of the ground, said T-post puller claw comprising:

a claw body including a first panel and a second panel, said first and second panels being constructed and arranged to define an included angle therebetween;

said first panel defining a T-post receiving opening having a generally triangular shape;

said second panel defining a chain-receiving opening, said chain-receiving opening having a first chain-securing slot; and said second panel further defining a second chain-securing slot that opens through an outer edge of said second panel and being spaced-apart from said first chain-securing slot.

2. The T-post puller claw of claim 1 wherein said chain is an interlocking link chain having a specified gauge diameter and a width dimension, said first chain-securing slot having a slot width larger than said gauge diameter and smaller than said width dimension.

3. The T-post puller claw of claim 2 wherein said second chain-securing slot having a slot width larger than said gauge diameter and smaller than said width dimension.

4. The T-post puller claw of claim 3 wherein said included angle is, between 75 degrees and 105 degrees.

5. The T-post puller claw of claim 4 wherein said claw body has a longitudinal centerline and said T-post opening is centered on said longitudinal centerline and said chain-receiving opening is centered on said longitudinal centerline.

6. The T-post puller claim of claim 1 wherein said chain is an interlocking link chain having a specified gauge diameter and a width dimension, said first chain-securing slot having a slot width larger than said gauge diameter and smaller than said width dimension.

7. The T-post puller claw of claim 6 wherein said second chain-securing slot having a slot width larger than said gauge diameter and smaller than said width dimension.

8. The T-post puller claw of claim 1 wherein said included angle is between 75 degrees and 105 degrees.

9. The T-post puller claw of claim 1 wherein said claw body has a longitudinal centerline and said T-post opening is centered on said longitudinal centerline and said chain-receiving opening is centered on said longitudinal centerline.

10. A T-post puller claw for use in pulling an installed T-post out of the ground, said T-post puller claw comprising:

a claw body including a first panel and a second panel, said first and second panels being constructed and arranged to define an included angle therebetween;

said first panel defining a T-post receiving opening;

said second panel defining a chain-receiving opening, said chain-receiving opening having a first chain-securing slot;

said second panel further defining a second chain-securing slot that opens through an outer edge of said second panel and being spaced-apart from said first chain-securing slot; and said claw body having a longitudinal centerline and said T-post opening being centered on said longitudinal centerline and said chain-receiving opening being centered on said longitudinal centerline.

11. The T-post puller claw of claim 10 wherein said chain is an interlocking link chain having a specified gauge diameter and a width dimension, said first chain-securing slot having a slot width larger than said gauge diameter.

12. The T-post puller claw of claim 11 wherein said second chain-securing slot having a slot width larger than said gauge diameter and smaller than said width dimension.

13. The T-post puller claw of claim 12 wherein said included angle is between 75 degrees and 105 degrees.

14. The T-post puller claw of claim 10 wherein said chain is an interlocking link chain having a specified gauge diameter and a width dimension, said first chain-securing slot having a slot width smaller than said width dimension.

15. The T-post puller claw of claim 14 wherein said second chain-securing slot having a slot width larger than said gauge diameter and smaller than said width dimension.

16. The T-post puller claw of claim 10 wherein said included angle is between 75 degrees and 105 degrees.

* * * * *